United States Patent [19]

Benisek

[11] 4,160,051

[45] Jul. 3, 1979

[54] ZIRCONIUM FLAME-RESIST TREATMENT

[75] Inventor: Ladislav Benisek, Ilkley, England

[73] Assignee: I.W.S. Nominee Company Limited, London, England

[21] Appl. No.: 703,912

[22] Filed: Jul. 9, 1976

Related U.S. Application Data

[63] Continuation of Ser. No. 235,866, Mar. 17, 1972, abandoned.

[51] Int. Cl.[2] ..... D06M 13/50

[52] U.S. Cl. ..... 427/352; 8/17; 8/128 R; 252/8.1; 423/464; 106/18.26; 106/18.28; 427/353; 427/354; 427/389; 427/390 D; 427/394; 427/430 R; 428/921

[58] Field of Search ..... 423/464, 390 D, 394; 252/8.1; 106/15 FD; 428/921, 263, 267, 270, 272; 427/430 R, 353, 354, 389; 8/17, 128 R

[56] References Cited

U.S. PATENT DOCUMENTS 2,424,262 7/1947 Wainer ..... 428/921 X

OTHER PUBLICATIONS

Blumenthal, *Rayon and Synthetic Textiles*, "Dyeing and Finishing," pp. 87–89, 10–1948.

*Primary Examiner*—John D. Smith
*Attorney, Agent, or Firm*—Dennis P. Clarke

[57] ABSTRACT

The flame resistance of wool and other polyamide fibres is enhanced by depositing in the fibres a complexed zirconium compound formed with an organic chelating agent or a halide. From 0.5 to 5% of Zr (as $ZrO_2$) is preferred and the zirconium should be in the form of an anionic complex and applied at a pH in the range 0.5 to 4. The complex can be applied by impregnation or exhaustion techniques or may be formed in situ in the fibres. Dyes including acid, premetallized and reactive dyes can be applied at the same time as the zirconium complex. Particularly preferred complexes include fluorozirconates, chlorozirconates and oxalic and citric acid complexes. Fluorocarbon and other oil- or water-repellent finishes are compatible with the zirconium complex.

8 Claims, No Drawings

ZIRCONIUM FLAME-RESIST TREATMENT

This is a continuation, of application Ser. No. 235,866, filed Mar. 17, 1972, now abandoned.

The present invention relates to textile finishing and more especially to the improvement in the properties of natural and synthetic polyamide fibres.

Naturally occurring polyamide fibres, for example the wool of sheep, display a high degree of natural flame retardancy because of their relatively high nitrogen and moisture content, high ignition temperature (570°-600° C.), low heat of combustion, low flame temperature and high limiting oxygen index.

The performance of wool fabrics in the various test methods currently in use depends on the specified test method and fabric construction. A horizontal test method is much less severe than a 45° or a vertical test. Most wool fabrics will pass a horizontal test but may not pass some 45° or vertical tests. The influence of fabric construction is also very important, the denser and heavier the fabric the lower the flammability. For example a conventional tufted pile wool carpet will pass the American "Tablet test" (DOC FF 1-70, DOC FF 2-70), while a carpet in the same material but having a loose or a longer pile may fail the same test.

It follows that wool in some cases needs a flame-resist treatment in order to pass a particular flammability specification and test method. Curtain and wall coverings in public buildings, aircraft furnishings and blankets, furnishings and curtains in general transport, protective clothing and carpets of shag pile construction and low density are products which may require treatment.

It has previously been proposed to apply titanium compounds to textile fibres as flame-proofing agents. Such compounds are not always suitable when wool fibres are used because they can cause yellowing. Moreover, although the process is satisfactory for many purposes, it is not entirely suitable for the manufacture of bleached wool articles.

The present invention provides a process for improving the flame-resist properties of natural or synthetic polyamide fibres which comprises depositing in the fibres a complexed zirconium compound wherein the complex is formed with an organic chelating agent or with halide, especially fluoride ions. For satisfactory results, 0.5 to 5% of zirconium calculated as $ZrO_2$ on the weight of wool (o.w.w.) is normally applied to the fibre. It is preferred that the zirconium is in the form of an anionic complex, and the preferred pH range for applying the zirconium solutions is 0.5 to 4, especially about 2. The complex is normally applied from solution, preferably aqueous solution and may be preformed or may be formed in situ in solution or on the fibres.

Zirconium compounds which can be used as starting materials include any water-soluble zirconium compound, such as zirconium acetate, zirconium oxychloride (zirconyl chloride), zirconium sulphate and potassium zirconium fluoride. The complexing agents which can be used if the zirconium is not already in the form of a complex include in addition to fluoride and other halide ions, fluoroborate ions (acting as a source of fluorine ions), citric, oxalic and tartaric acids. When the complexing agent is fluoride ions, it may also be advantageous to add an organic complexing agent, for example citrate ions. The zirconium compound can be in the complexed state before it is applied to the fibres, or alternatively the complex can be formed in situ.

One class of complex zirconium compound which can be employed with especial advantage is the alkali metal or ammonium fluorozirconates. These compounds are applied directly to wool as aqueous solutions, preferably in a concentration range of 2-15% o.w.w and more especially about 5%. The preferred compound is potassium zirconium fluoride.

The zirconium in the treating solution is preferably stabilised as a water-soluble complex, otherwise polymerisation and/or precipitation of zirconium dioxide may occur either at room temperature or on boiling. When using organic complexing agents the zirconium is preferably applied to the fibres at or near the boil. When fluoride ions are present, the zirconium can be applied at temperatures in the range 10°-60° C., especially about 50° C. Both polymerisation and precipitation can result in an ineffective flame-resist treatment. Since aqueous solution of zirconium compounds precipitate zirconium dioxide in the presence of a base, the solution applied to the wool is normally acidic.

While the invention does not depend upon any particular theory as to its mode of operation, it is believed that the application of zirconium in the form of a complex enables the zirconium to penetrate into the interior of the fibre, especially when using wool fibres, which are preferred, where it can then react with, for example, amino groups within the fibre to become chemically bonded thereto. Furthermore, at the acid pH values used the wool is in a positively charged state, and a more satisfactory exhaustion of the zirconium is obtained when it is applied in the form of anionic complex ions such as $ZrCl_6^{2-}$, $ZrF_6^{2-}$, $ZrF_7^{3-}$ and $(Zr(C_2O_4)_4)^{4-}$. In the case of synthetic polyamide fibres such as nylon 6, nylon 66 or nylon 10, the complexed zirconium compound can react either within the fibre or on the fibre surface.

The zirconium compound can be applied to the fibres by any conventional method, including the pad-dry, pad-batch, spray-nip-dry and the exhaustion method, which is preferred.

The term "pad-dry" as used herein means the method of applying a liquor or paste to fibres to be treated by padding followed by drying. The term "spray-nip-dry" means the method of spraying a liquor onto the fibres to be treated, passing them through a nip, and subsequently drying them. The term "exhaustion" means the method of treating the fibres in a bath with a solution of the active substance until it is substantially completely taken up, and subsequently drying them.

Conventional machinery for treating textiles and garments with liquors may be used, including dollies, winches, beam dyeing equipment, packing dyeing machinery, hank dyeing machinery, top dyeing equipment, side paddle dyeing machines, washing and laundering equipment and dry cleaning machinery for batchwise treatments and including pad mangles, lick-rollers, spray units, continuous cloth washing units, back washing machines and solvent scouring machines for continuous and semi-continuous treatments.

The invention may be applied to the treatment of synthetic polyamide fibres, for example nylon, but is especially valuable for the treatment of natural polyamide fibres. Preferably the fibres are of sheep's wool but they can also be derived from alpaca, cashmere, mohair, vicuna, guanaco, camel hair, silk, and llama, or of blends of these materials with sheep's wool. Fabrics consisting of a blend containing major proportion of wool and a minor proportion, generally 20% or less, of synthetic fibres or natural cellulosic fibres which do not in themselves have a high degree of flame-resistance for example polyamide, polyester or cotton fibres, may also be treated. It is also possible to treat blends containing less than 80% wool, the remainder comprising a flame-resistant man-made fibre, for example aromatic polyamide fibres (sold under the trade name NOMEX by I. E. Du Pont de Nemours & Co.), polybenzimidazole fibres, cross-linked phenolic fibres (Kynol, Carborundum Co.), polyvinyl chloride fibres, polyvinylidine chloride fibres, modacrylic fibres and flame-resist treated rayon fibres. The treatment may be applied to the fibres at any desired stage during textile processing, and the fibres may, for example, be in the form of fleeces, tops card silver, noils, yarns, threads, woven or knitted fabrics, non-woven fabrics, pile fabrics, garments or sheepskins. Preferably the material to be treated is scoured to a residual methylene chloride extract of not more than 0.8% in order to remove spinning additives or natural waxes which can contribute to the flammability of the product.

The fibres may additionally be treated with other known substances imparting flame-resist properties. Such substances include antimony compounds, especially antimony trifluoride or antimony potassium tartrate, and aluminium compounds, especially aluminium sulphate ($Al_2(SO_4)_3.16H_2O$), or aluminium chloride. Features of the principal methods for treating the fibres are described hereinafter.

(a) Exhaustion Method

The fibres are treated with an aqueous solution of a zirconium compound at a pH of 0.5 to 3 and at a liquor ratio of about 1 to 20, and preferably not more than about 1 to 30. Exhaustion of the zirconium compound is normally complete after a boiling period of 30 minutes to 2 hours, generally about 1 hour. The zirconium complex is preferably present in a concentration from 1% to 3% by weight on the weight of fibres calculated as $ZrO_2$. When using zirconium oxychloride solutions, stabilisation by, for example, fluoride or citrate may be incomplete and there may be some precipitation of zirconium dioxide on prolonged boiling. Nevertheless, a flame-proofing effect can be obtained with this substance. It is however preferred to use solid zirconium oxychloride, or potassium zirconium fluoride which are readily stabilised in dilute solution by ammonium bifluoride, are very stable, and are stable to hydrolysis.

The exhaustion of zirconium from the treatment solution can be followed measuring the fluorescence of MORIN ($3,4,7,2^14^1$-pentahydroxy-flavone) when exposed to ultraviolet radiation. 3 ml of a 5% solution of MORIN in ethanol are added to a 10 ml sample of the treatment solution. After exhaustion is complete only a very slight green fluorescence is observed. The amount of zirconium exhausted on wool during the flame-resist treatment can be estimated as ash content (metal oxides). As wool always contains some inorganic matter the increase in ash content due to mordanting should always be estimated as the difference between the ash content of flame-resist treated and untreated wool during the treatment. This method is especially useful when the flame-resist treatment is performed simultaneously with dyeing, in which case the dyestuffs may fluoresce and interfere with the MORIN fluorescence test.

The present process may be carried out at the same time as dyeing provided that the dye is capable of exhausting onto wool at a pH below 5. Such dyes are generally water-soluble and contain anionic solubilising groups. Acid levelling, 1:1 premetallised and certain reactive dyes can be applied simultaneously with the zirconium treatment and there is no need to add additional formic or sulphuric acid as is conventional with these dyes since the pH of the dyebath is already sufficiently low. Glauber's salt and sulphuric acid are preferably not to be added to the solution since they interfere with the exhaustion of the zirconium complex but organic nonionic levelling agents, for example, those sold under the trade names Avolan SC or Albegal B can be used. When using an acid milling or 1:2 premetallised dye the dye can first be exhausted at the boil, the temperature of the dye bath is reduced to 70° C., the complexed zirconium compound is then added and the bath is then further heated until the zirconium complex has exhausted onto the wool. When dyeing with chrome dyes, the dyeing operation must be carried out after the zirconium treatment, otherwise complex formation between the titanium in solution and the dye can give rise to a colour change.

The zirconium treatment is very advantageous in that it does not give rise to yellow discolouration of the wool and does not promote yellowing on exposure to light and pastel shades are not significantly altered by the treatment. When no dye is added, the product has the natural colour of the wool, and may if desired be bleached by treatment with a hydrogen peroxide bleach or a reductive bleach such as sodium hydrosulphite or bisulphite. Bleaching, when required, can be carried out after the zirconium treatment, or before the treatment provided that the temperature used in the zirconium treatment do not approach boiling.

Reductive bleaching can be carried out by heating the wool with a stabilised hydrosulphite at a concentration of about 5 grams per liter at a temperature of 50°–70° C. for 1–2 hours. A milder reducing bleach can be obtained by boiling with sodium bisulphite (about 5 g/l) at 50° C. for 1 hour. Bleaching may be carried out using 0.3%–0.7% w/v hydrogen peroxide solution, and it is preferred to include a stabiliser based on silicates, for example 3–5 g/l sodium silicate and to maintain the treatment bath at 50° C. for 1–2 hours. If the wool has previously been damaged for example by weather, then 4% formaldehyde 40% o.w.w. may be added to the zirconium treatment bath to protect the wool during boiling.

(b) Pad-batch Method

The zirconium compound may be applied to the fibres to be treated in a pad mangle. The fibres can be dyed prior to treatment. A suitable treatment composition comprises an aqueous solution of zirconium oxychloride, ammonium bifluoride and formic acid. After treatment the fibres are wound onto a former and stored in the presence of moisture for about one hour, rinsed with water and dried. The pad-batch treatment is especially useful for the treatment of dyed fabrics wherein the dyestuff is not stable to boiling at pH 0.5 to 3.

The treatment according to the invention has the further advantage that it is compatible with fluorocarbon oil-and-water repellent treatments for upholstery fabrics for use, for example, on aircraft seats. Fluorocarbon resins, for example FC-214, FC-208, FC-218, all available from the 3M company can be applied preferably in the presence of an extender, for example Phobotex FTN (CIBA). The zirconium and fluorocarbon can be applied simultaneously by padding followed by drying at a temperature of at least 100° C., further heating for a period and at a temperature sufficient to cure the resin, washing and drying. The zirconium treatment can be also applied by any of the methods described herein before or after the water and oil-repellent treatment.

(c) Spray-nip-dry method

A suitable composition for application to fabrics, especially pile fabrics, by spraying comprises an aqueous solution of zirconium oxychloride and ammonium bifluoride, such a composition is especially useful for the treatment of made-up carpets.

The invention is illustrated by the following examples. (The expression "o.w.w." means on the weight of wool.)

(d) Flame resistance

The flame-resistance of textile fabrics can be measured by the Vertical Flame Test (A.A.T.C. Test Method 34-1969, Fire Resistance of Textile Fabrics) which involves suspending a conditioned (65% relative humidity) strip of the fabric to be tested in a flame of a Bunsen burner for twelve seconds and determining the length of the charred portion of the fabric and the burning time. The flame-resistance of carpets can be measured by the Tablet Test (U.S. Federal Specification DOC FF 1-70 which involves drying a specimen of the carpet at 105° C. for 2 hours, igniting a standard time-burning "Methanamine" (Hexamethylenetetramine) tablet on the surface of the carpet, and observing the spread of flame over the surface of the carpet. It is an object of the present invention to provide textile materials which pass these tests, hereinafter referred to as the "Vertical Flame Test" and "Tablet Test" respectively.

EXAMPLE 1

Undyed woollen yarn was treated by exhaustion with the following solution:

| | |
|---|---|
| Zirconium oxychloride ($ZrOCl_2 . 8H_2O$). | 6% o.w.w. |
| Citric acid | 4% o.w.w. |
| Hydrochloric acid (37%) | 5% o.w.w. |

The solution was boiled in contact with the yarn for 45 minutes after which the zirconium had substantially completely exhausted onto the yarn, only a faint green fluorescence being observed with Morin. The treated yarn was then rinsed, hydro-extracted and dried. The yarn was made up into a woven fabric which easily passed the Vertical Flame Test. The treatment was fast to at least 10 washings (45° C., 15 minutes, 1:20 Phillips automatic washing machine) and 10 dry cleanings (25° C., 15 minutes, 1:20 Perklene, launderometer).

The made-up fabric was a very satisfactory natural colour which compared favourably with the colour before treatment. The whiteness was further improved by treatment of the fabric with a solution containing:

| | |
|---|---|
| Hydrogen peroxide | 0.6% |
| Sodium Silicate | 5 g/liter |

The treatment was carried out for 1 hour at 50° C. and liquor ratio 1:20 and the treated fabric was again rinsed, hydro-extracted and dried. The product was a bleached wool fabric which easily passed the Vertical Flame Test and was fast to washing and dry-cleaning as before.

EXAMPLE 2

Samples of the zirconium treated wool yarn from Example 1 were formed into a shag-pile carpet by means of a tufting machine. The carpet had a pile length of 5.0 cms. It easily passed the Tablet Test. Further samples of the yarn were bleached prior to tufting using the solution and conditions described in Example 1. The tufted carpet made from the bleached yarn again easily passed the Tablet Test.

EXAMPLE 3

The following composition was applied to a knitted woollen jersey fabric:

| | |
|---|---|
| Zirconium oxychloride | 9% o.w.w. |
| Ammonium bifluoride | 4% o.w.w. |
| Hydrochloric acid (37%) | 5% o.w.w. |
| Glauber's Salt | 5% o.w.w. |
| Naphthalene Orange G | 1% o.w.w. |

The solution was exhausted onto the fabric by boiling for 60 minutes at a liquor ratio of 1:20 after which both the dye and the zirconium were found to have exhausted onto the wool fabric. A bright yellow product was obtained which was hydro-extracted and dried. It easily passed the Vertical Flame Test.

EXAMPLE 4

The following composition was applied to a knitted woollen jersey fabric:

| | |
|---|---|
| Potassium fluorozirconate | 8% o.w.w. |
| Hydrochloric acid (37%) | 10% o.w.w. |

The solution was exhausted onto the fabric at 50° C. within 60 minutes at a liquor ratio of 1:20. The treated fabric was then hydro-extracted and dried. The product was a wool fabric which passed the Vertical Flame Test.

EXAMPLE 5

A woollen textile fabric was treated with the following aqueous solution by means of a pad mangle.

| | |
|---|---|
| Zirconium oxychloride ($ZrOCl_2 8H_2O$) | 8% o.w.w. |
| Ammonium bifluoride | 4% o.w.w. |
| Formic acid (80-90%) | 2% o.w.w. |
| Tergitol Speedwet | 2 g/l |

Tergitol speedwet is a non-ionic wetting agent. The fabric was then dried, rinsed with water in a winch at 20° C. and liquor ratio 1:20 and again dried. The dried fabric passed the Vertical Flame Test.

EXAMPLE 6

To improve the whiteness and flame-resistance of a zirconium treated wool yarn, it was bleached with hydrogen peroxide and sodium silicate in a liquor of the following composition:

| | |
|---|---|
| Hydrogen peroxide | 0.6% |

-continued

| | |
|---|---|
| Sodium silicate (35%) | 5 g/l |

The wool was bleached for 1 hour at 50° C., liquor ratio 1:20 and the wool was rinsed, hydro-extracted and dried. A shag-pile carpet with at 6.0 cm pile length made from the flame-resist treated yarn easily passed the Tablet Test and the whiteness was 20% higher than with the untreated yarn.

The knitted woollen jersey fabric which was flame-resist treated and bleached passed the Vertical Flame Test and the whiteness was further improved when compared with the untreated fabric.

EXAMPLE 7

In order to correct the slight wool yellowing due to boiling a reducing bleaching agent (Lufibrol FW - B.A.S.F.) was added to a flame-resist treatment bath according to Example 1 at 1% o.w.w. concentration and the exhaustion was carried out exactly as in Example 1. A fabric made from the flame-resist treated yarn passed the Vertical Flame Test and the original whiteness of the yarn was retained after the flame-resist treatment without any bleaching after-treatment.

EXAMPLE 8

A wool shag-pile carpet was sprayed with the following formulation:

| | |
|---|---|
| $ZrOCl_2 8H_2O$ | 6% o.w.w. |
| $NH_4F . HF$ | 3% o.w.w. |
| HCOOH 80% | 1% o.w.w. |
| Wetting agent | 1 g/l |

The pick-up of the pile was 60%. After spraying the carpet was passed through a nip to ensure proper treatment and penetration of the flame-resist solution into the wool fibres and finally the carpet was dried at 110° C. The treated carpet easily passed the Tablet Test.

EXAMPLE 9

An undyed New Zealand carpet wool in hank form was flame-resist treated as follows:

5% potassium fluorozirconate o.w.w. and 5% o.w.w. hydrochloric acid 37% were dissolved in water and added to the treating bath at 20° C. The bath was heated to 50° C. at a rate of 4° C./min. in the presence of the wool and kept at this temperature for 45 minutes at a liquor ratio of 1:25 after which 85% of the zirconium had exhausted on the wool. After the wool had been rinsed, hydro-extracted and dyed a shag-pile carpet (pile height 5 cm. sheared pile weight 950 g/m$^2$) was manufactured. The carpet easily passed the Tablet Test and the treatment was fast to at least 10 washings (15 minutes, 60° C., 1:20, 2 g/l soap). The natural white colour of the yarn was not impaired by the zirconium flame-resist treatment.

EXAMPLE 10

A woven wool curtain fabric was treated on a pad mangle with the following aqueous solution:

| | |
|---|---|
| Zirconium oxychloride ($ZrOCl_2 . 8H_2O$) | 8% o.w.w. |
| Ammonium bifluoride | 4% o.w.w. |
| Formic acid | 2% o.w.w. |

-continued

| | |
|---|---|
| "Tergitol Speedwet" | 2 g/l |

Tergitol Speedwet is a commercially available surface active agent. The wet pick up on the padded fabric was 75–80%. The fabric was then stored for 1 hour on a rotating roller with a polyethylene foil cover to allow the zirconium to penetrate into the fibres, and then rinsed in a winch with water at 18° C. for 10 minutes at a liquor:goods ratio of 1:20. The dried fabric passed the Vertical Flame Test (U.S. Federal Specification C.C.C.T. 19 lb. 1951 method 5902) in its original state and after 10 washings.

EXAMPLE 11

This example describes the flame-resist treatment of wool sheepskins, which were treated in a side-paddle at 50° C. for 45 minutes at a liquor ratio 1:20 with the following chemicals:

| | |
|---|---|
| 10% potassium fluorozirconate | o.w.w. |
| 10% hydrochloric acid 37% | o.w.w. |

After the treatment, the sheepskins were well rinsed with water and dried at 50° C. to preserve the natural soft handle of the skin. The pile of the treated sheepskin did not change its natural white colour and soft handle and easily passed the American Tablet Test Federal Specification DOC FF 2-70, while the same untreated sheepskin failed the same specification.

EXAMPLE 12

This example describes the continuous flame-resist treatment of loose wool stock in the last bowl of a raw wool scouring set. The concentration of the chemicals in the last bowl was as follows:

| | |
|---|---|
| 60 g/l | zirconium oxychloride |
| 30 g/l | ammonium bifluoride |
| 20 g/l | formic acid |

The temperature of the bath was 45° C. and the loose stock passed continuously through the bowl for 4 minutes, was squeezed to a 35% moisture content, dried and passed through a mechanical shaker to remove residual chemicals on the surface of the fibre. The handle and colour of the treated wool was unchanged and when fabricated into a shag-pile carpet, it easily passed the Tablet Test.

EXAMPLE 13

This example describes the simultaneous flame-resist treatment and dyeing of a wool/nylon 80/20 yarn which was processed in a hank dyeing machine by the following recipe:

| | |
|---|---|
| 5% potassium fluorozirconate | o.w.w. |
| 10% hydrochloric acid 37% | o.w.w. |
| 1% Alizarin Red S | o.w.w. |

The material was maintained at the boil for 45 minutes at a liquor: goods ratio of 20:1. The dye which is of the acid levelling type exhausted onto the wool and a loose shag pile carpet made from the treated yarn was tested in accordance with Federal Specification DOC FF 1-70

(Tablet Test). Although the flame-spread was more noticeable than with an all wool carpet of similar construction the carpet made from the wool/nylon blend passed the required specification.

EXAMPLE 14

This example described the flame-resist treatment by the low temperature technique of a wool blanket containing 15% cotton in warp direction. The blanket was first dyed in a winch to a baby blue shade with fibre-reactive dyes in a manner known per se and then flame-resist treated as follows:

| | |
|---|---|
| 8% potassium fluorozirconate | o.w.w. |
| 10% hydrochloric acid 37% | o.w.w. |

The goods were maintained for 45 minutes at a temperature of 50° C. at a liquor:goods ratio of 20:1. The original shade was not altered by the treatment and the blanket easily passed the Vertical Flame Test.

EXAMPLE 15

A blended fabric consisting of 60% wool and 40% of Nomex (a flame-resistant aromatic polyamide synthetic fibre) was treated as described in Example 14 and the treated fabric had superior textile properties and better flame-resistance than all Nomex fabric of similar weight and construction.

EXAMPLE 16

This example describes the flame-resist treatment of a fabric containing 50% of wool and 50% of a modacrylic fibre (Teklan), which is a flame-resistant synthetic fibre. The treatment was carried out as in Example 14. The treated fabric has superior handle, lower smoke emission and better flame-resistance than all Teklan fabric.

EXAMPLE 17

This example describes the flame-resist treatment of a blend containing 40% wool and 60% of a permanently flame-resistant rayon (PFR Rayon, American Rayon). The flame-resist treatment was carried out as in Example 14. The flame-resist treated fabric had superior textile properties (tensile strength, extension at break, abrasion resistance etc.) handle and flame-resistance than all PFR Rayon fabric.

What I claim is:

1. A process for improving the flame resist properties of natural and synthetic polyamide fibers which comprises applying to scoured natural or synthetic polyamide fibers having a residual methylene chloride extract of not more than 0.8% an aqueous solution containing an anionic zirconium complex ion selected from the group consisting of a fluorozirconate and a complex of zirconium with an organic chelating agent, said solution having a pH in the range of 0.5 to 4.0, whereby to impregnate the substance of said fibers with said anionic zirconium complex and thereafter drying said fibers, the proportion of said zirconium complex in relation to said fibers being sufficient to satisfy at least the minimum requirements of the Vertical Flame Test—A.A.T.C. Test Method 34-1969, Fire Resistance of Textile Fabrics.

2. The process of claim 1 wherein said anionic complex is a complex of zirconium and citric, oxalic or tartaric acid.

3. The process of claim 1 wherein said anionic complex is formed in situ by reaction of a water soluble zirconium compound with a sufficient amount of complexing agent to form said anionic complex.

4. The process of claim 3 wherein said water soluble zirconium compound is zirconium oxychloride.

5. The process of claim 1 wherein the pH is about 2.

6. The process of claim 1 wherein said complex is a fluorozirconate.

7. The process of claim 6 wherein said complex is applied at a temperature of 10°–60°C.

8. The process of claim 1 wherein said complex is applied by exhaustion at the boiling point of the solution.

* * * * *